US006918678B2

(12) United States Patent
McClanahan

(10) Patent No.: US 6,918,678 B2
(45) Date of Patent: Jul. 19, 2005

(54) HEADSET INCORPORATING AN INTEGRAL LIGHT

(76) Inventor: John B. McClanahan, 252 Ebenezer Rd., Fayetteville, GA (US) 30215

( * ) Notice: Subject to any disclaimer, the term of this patent is extended or adjusted under 35 U.S.C. 154(b) by 7 days.

(21) Appl. No.: 10/417,755

(22) Filed: Apr. 17, 2003

(65) Prior Publication Data

US 2003/0202341 A1 Oct. 30, 2003

Related U.S. Application Data

(60) Provisional application No. 60/376,413, filed on Apr. 29, 2002.

(51) Int. Cl.[7] ..... F21V 21/084

(52) U.S. Cl. ..... 362/105; 362/253; 362/800; 362/234

(58) Field of Search ..... 362/105, 106, 362/103, 253, 800, 234; 2/209, 422, 906; 200/336, 5 R, 5 B

(56) References Cited

U.S. PATENT DOCUMENTS

| | | | | | |
|---|---|---|---|---|---|
| 4,131,033 | A | * | 12/1978 | Wright et al. | 74/553 |
| 4,494,074 | A | | 1/1985 | Bose | 330/109 |
| 4,969,069 | A | | 11/1990 | Eichost | 362/105 |
| 5,083,246 | A | | 1/1992 | Lambert | 362/471 |
| 5,353,205 | A | | 10/1994 | Hudak | 362/105 |
| 5,951,141 | A | | 9/1999 | Bradley | 362/105 |
| 6,179,452 | B1 | * | 1/2001 | Dunning | 362/470 |
| 6,278,786 | B1 | * | 8/2001 | McIntosh | 381/71.6 |
| 2002/0027777 | A1 | * | 3/2002 | Takasu | 362/105 |
| 2002/0129989 | A1 | * | 9/2002 | Parsons | 181/131 |

* cited by examiner

*Primary Examiner*—Sandra O'Shea
*Assistant Examiner*—Sharon Payne
(74) *Attorney, Agent, or Firm*—Thomas, Kayden, Horstemeyer & Risley, L.L.P.

(57) ABSTRACT

A headset with a light incorporated within is disclosed. A representative embodiment of the invention may be construed as an aviation-style headset that includes a first earcup and a second earcup each comprising active noise reduction (ANR) circuitry, a headband interconnecting the first earcup and the second earcup, and a boom microphone coupled to one of the first and second earcups. The headset also includes a rotating housing coupled to at least one of the earcups. A first light-emitting diode (LED) is mounted in the rotating housing. The rotating housing is rotated to point light from the LED in a desired direction. The headset also includes a switch mounted to one of the earcups for controlling the LED. The ANR circuitry is electrically coupled to at least the first LED to deliver power to the LED. Other systems and devices are also disclosed.

1 Claim, 3 Drawing Sheets

HEADSET INCORPORATING AN INTEGRAL LIGHT

CROSS-REFERENCE TO RELATED APPLICATION

The present application claims the benefit of the filing date of U.S. Provisional Patent Application Ser. No. 60/376,413, filed Apr. 29, 2002, and entitled "Aviation Style Headset Incorporating an Integral Light," which is incorporated by reference herein in its entirety.

FIELD OF THE INVENTION

The present invention generally relates to head-mounted equipment. More specifically, the invention relates to headsets, such as aviation-style headsets, that incorporate an integral light.

DESCRIPTION OF THE RELATED ART

Several prior art attempts at incorporating lighting with head-mounted equipment such as headsets, headphones, and earmuffs have been made. Generally, the purpose of incorporating lighting into such equipment is to provide a source of light that illuminates a work area generally directly in front of a person wearing the equipment. Perhaps the earliest of such innovations can be seen in mining helmets with lights mounted on the front side of the helmets.

Today, many occupations still require the use of head-mounted equipment. Of particular interest are pilots that require aviation-style headsets. The headsets generally include earphones and a microphone to communicate with co-pilots and radio tower operators. The headsets also help in muffling ambient noise that may be present, such as noise generated by airplane engines. Pilots often work in a dark environment thus requiring local lighting at certain times during a flight.

As mentioned, several types of head-mounted lighting devices are known in the prior art. For example, U.S. Pat. No. 4,969,069 to Eichost, discloses a set of hearing protectors (ear muffs) with flashlights incorporating conventional incandescent light bulbs and batteries for the purpose of providing hands-free illumination in a high-noise environment.

U.S. Pat. No. 5,083,246 to Lambert, describes an apparatus for illuminating a portion of the cockpit of an aircraft utilizing a night vision imaging system with green light in the frequency range of 562 to 567 nanometers. This apparatus may be mounted on a microphone adjacent to and controlled by the wearer's mouth, lips, or tongue.

U.S. Pat. No. 5,535,205 to Hudak, describes a detachable, rotating light intended to be mounted on an aviation-style headset primarily intended for use in an emergency situation. This headset incorporates batteries into the light housing and provides illumination with a conventional, incandescent light bulb.

U.S. Pat. No. 5,951,141 to Bradley, describes a head-mounted illumination device which mounts to the mouthpiece or boom microphone of a headset. The housing which contains the light also contains a switch which is operated by the mouth of the user. Batteries provide power and are mounted on the headset itself.

While all of the aforementioned devices may fulfill their unique purposes, none of them fulfill the need for a practical cockpit illumination device which provides white light without adding the weight and inconvenience of batteries to the headset.

SUMMARY OF THE INVENTION

A first embodiment of the invention may be construed as an aviation-style headset that includes a first earcup and a second earcup each comprising active noise reduction Active Noise Reduction (ANR) circuitry, a headband interconnecting the first earcup and the second earcup, and a boom microphone coupled to one of the first and second earcups. The headset also includes a rotating housing coupled to at least one of the earcups. A first light-emitting diode (LED) is mounted in the rotating housing. The rotating housing is rotated to point light from the LED in a desired direction. The headset also includes a switch mounted to one of the earcups for controlling the LED. The ANR circuitry is electrically coupled to at least the first LED to deliver power to the LED.

Another embodiment of the present invention may be construed as a headset system. The system includes a headset comprising an earcup having ANR circuitry and a light for illuminating an area in front of a wearer of the headset. The power required to drive the light is provided via the ANR circuitry in the earcup.

Yet another embodiment of the present invention may be construed as a headset system. The system includes a headset comprising an earcup. The system also includes an LED for illuminating an area in front of a wearer of the headset, means for controlling the LED, and means for supplying power to the LED.

Other systems and devices of the present invention will be or may become apparent to one with skill in the art upon examination of the following drawings and detailed description. It is intended that all such additional systems and devices be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

As will be described in greater detail herein, systems and devices of the invention can provide illumination to a wearer of a headset. As used here, "headset" means any device incorporating at least one earcup that may be worn by a user to either reduce ambient noise or provide sound to the user, or both. For example, headphones, ear muffs, and earphones may be considered types of headsets.

Figure 1:
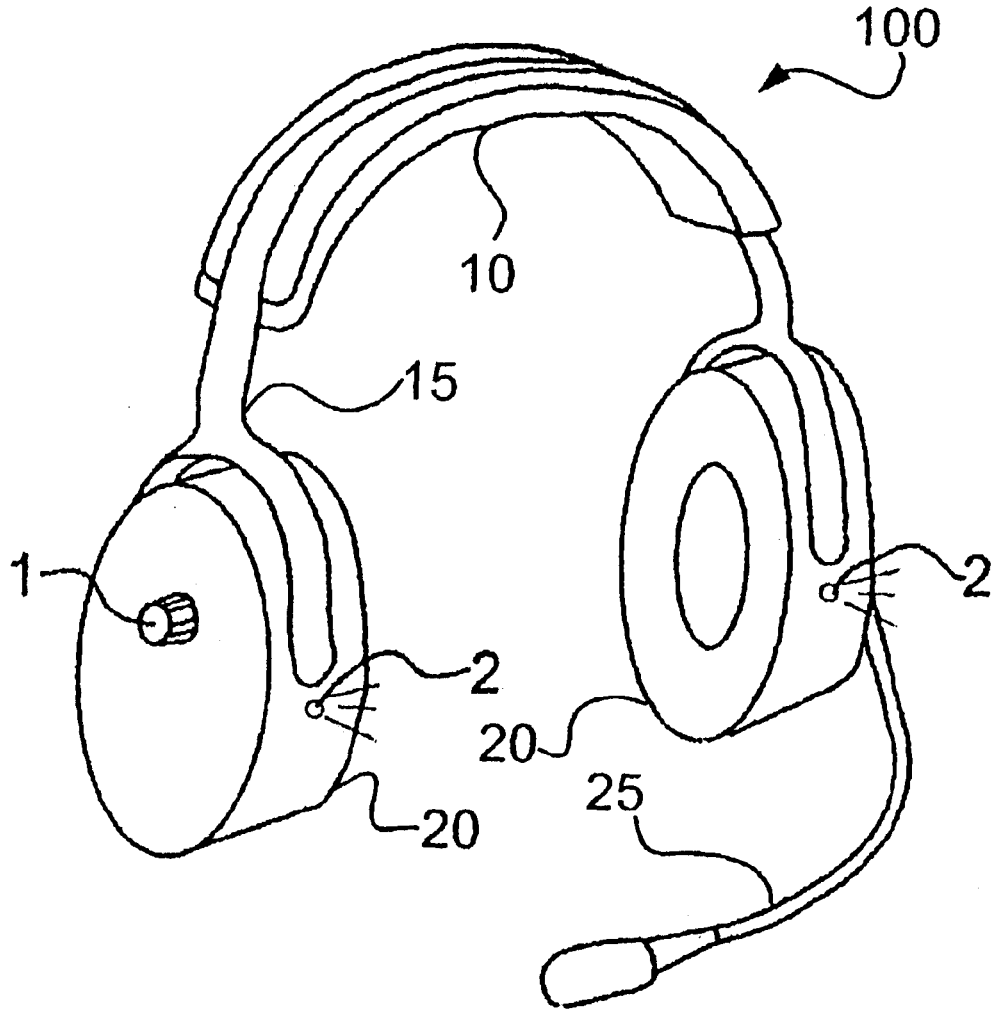
FIG. 1 is a perspective view of a first embodiment of an aviation-style headset.

Referring now in more detail to the drawings, FIG. 1 is a perspective view of a first embodiment of an aviation-style headset 100. The headset 100 includes two earcups 20 that are sized, shaped, and arranged to be positioned over the ears of a user. A headband 15 is coupled to the earcups 20 in a wishbone style as illustrated. The headband 15 could also be coupled to the earcups 20 in alternative manners. The headband 15 includes a headband pad 10 that provides extra padding so as to provide a comfortable fit atop the user's head. The headband pad 10 could be excluded. A boom microphone 25 is included in the headset 100. The boom microphone 25 may be mounted to one of the earcups 20, or to the headband 15. Alternatively, a boom microphone 25 may be excluded. Although not shown, a cord for communicating signals to an intercom system is often included with the headset 100. In some embodiments, the cord may also deliver power to the headset 100.

The earcups 20 comprise a foam padding for comfortably pressing against the head of the user. The earcups 20 may also include a hard plastic exterior for providing durability. Other similar earcups 20 may also be utilized. In other embodiments, a headset may include only one earcup 20.

A light-emitting diode (LED) 2 is located within the side of each earcup 20 and directs light toward the working area of the user. In this embodiment, it is preferable, although not necessary, that the LED 2 emit white light. Japanese patent 2,626,404 to Nakamura, incorporated by reference herein in its entirety, discloses technology related to white LEDs. Because of their minimal power consumption, (approximately 1.2 milliwatts), they have made lighting available where it heretofore has been impractical. In addition to the low power consumption of LEDs, they are also beneficial because they are typically of minimal size, negligible weight, and are mechanically rugged. The LEDs 2 in this embodiment are built into the earcups 20 and do not extend significantly outward from the surface of the cup 20 where they could potentially become subject to damage or interference with other equipment. Alternatively, only one earcup 20 may include the LED 2. In other embodiments, a cluster of LEDs 2 could be mounted within the earcup 20 to produce a more intense light beam. In these embodiments, it may be advantageous to also have a lens structure to help in focusing the light beam. In yet other embodiments, the LED 2 may be mounted to the boom microphone 25. Although LED 2 is the preferred lighting element, other lighting elements could be utilized. For example, incandescent bulbs could be utilized.

A volume control knob 1 projects from one, or both, of the earcups 20. In this embodiment, volume control knob 1 is a combination switch/potentiometer which, when rotated, adjusts earcup volume and when pulled out, switches on the LED(s) 2. In this embodiment, the control knob 1 controls the volume of both earcups 20 and also both LEDs 2. Accordingly, a control signal may be delivered from one earcup 20 to another via the headband 15, as is known in the art. Alternatively, separate control knobs 1 may be mounted on each earcup 20 to control the volume and LEDs 2 of each earcup 20 separately. Alternatively, the switch 1 may be located on the headband 15 or incorporated into the boom microphone 25.

In other embodiments, another set of LEDs 2 may be located within the backside of the earcups 20. In this manner, a user may then be able to select which way to wear the headset while still benefiting from the full functionality of the headset 100. For example, one user may prefer to wear the boom microphone 25 on the left side, whereas another user may prefer to wear the boom microphone 25 on the right side. In this latter scenario, the user can flip the headset 100 around. The control knob 1 may alternatively provide a three-way control switch for the LEDs 2. In this manner, the user can select which LEDs 2, front or back, to illuminate. In other embodiments, the position of the boom microphone 25 may dictate which LEDs 2 will be illuminated. In this approach, a control switch may be integrated in with the boom microphone 25 and earcup 20 connection.

It should be appreciated, that other means for controlling the LEDs 2 could be utilized. For example, a separate switch mounted on the earcup 20 may be utilized. Alternatively, the control switch may be remote from the headset 100. For example, the switch may be mounted to the instrument panel of the cockpit, or on the control stick or yoke of the vehicle. A control circuit may run from the intercom system to the headset 100 to connect a remote switch to the headset 100.

Power may be delivered to the LEDs 2 from various sources. A first source may be from an external power supply via the communication cord (not shown). The external power supply may be incorporated into the intercom system or may be from the vehicle itself. Another source of power may be found within the earcups 20. For example, batteries may be mounted within the earcups 20, or to the headband 15.

Because of the LEDs 2 low power consumption, power may be drawn from active noise reduction (ANR) circuitry found within the earcups 20. U.S. Pat. No. 4,494,097 to Bose, incorporated by reference herein in its entirety, relates to ANR technology as a means for reducing ambient noise in headphones. Since ANR uses active electronic circuitry, ANR-type headsets require a power source. This power source then is available to power other circuits if power requirements are small. The power for the ANR circuitry may be provided by a local power source such as a battery, or may be provided externally, via the communication cord as discussed earlier.

Figure 2:
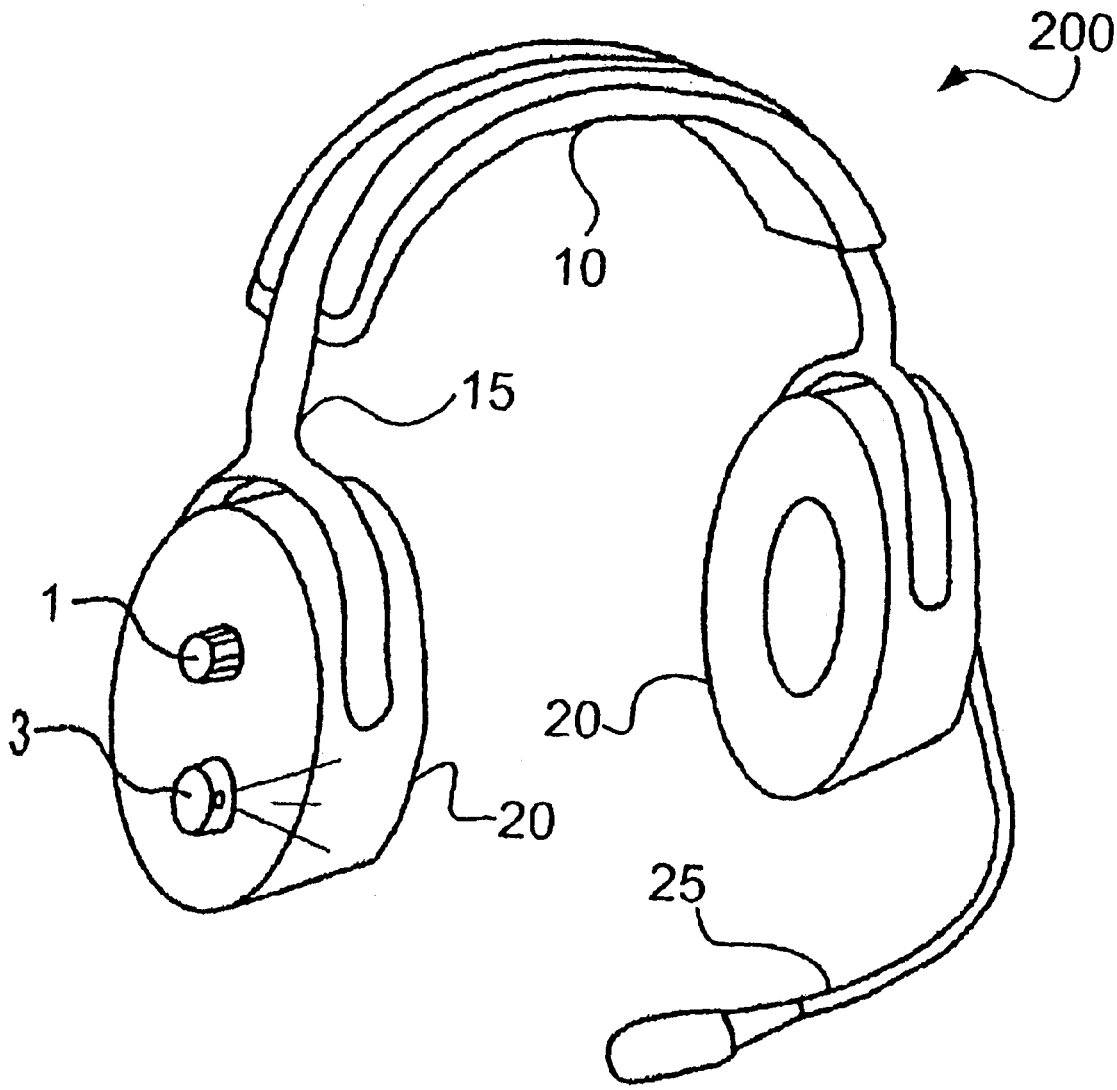
FIG. 2 is a perspective view of a second embodiment an aviation-style headset.

FIG. 2 is a perspective view of a second embodiment of an aviation-style headset 200. The second embodiment is similar to the first embodiment in that an LED or LEDs 2 are mounted to an aviation-style headset 200. A control knob 1 can control the LED(s) 2. ANR circuitry is found in the earcups 20 and power is delivered to the LED(s) 2 via the ANR circuitry. In this embodiment, however, a rotating housing 3 is mounted to one or both earcups 20. The rotating housing 3 houses the LED 2. The rotating housing 3 may be rotated by the user to control the direction in which the LED 2 projects light.

Figure 3:
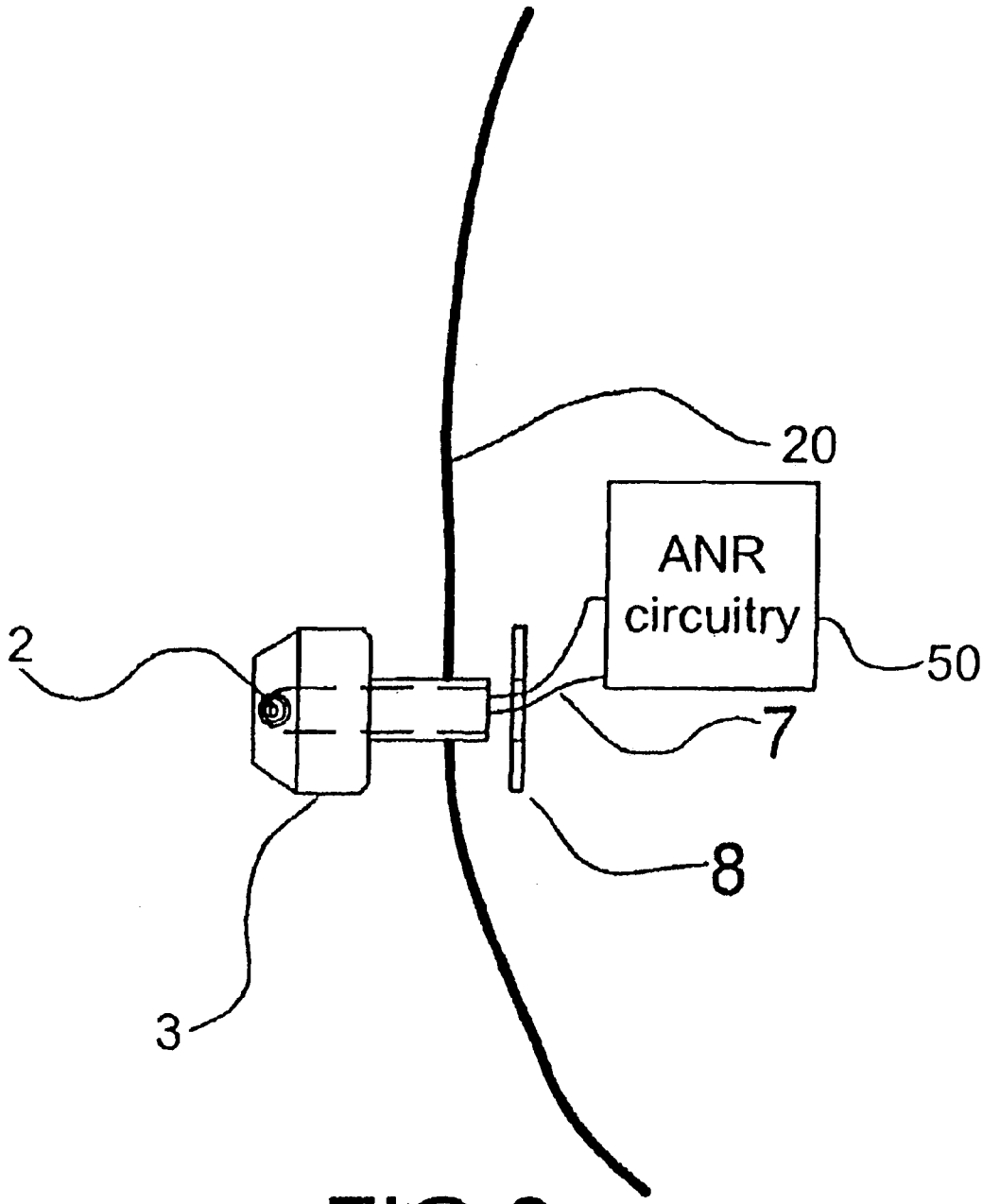
FIG. 3 is an exploded view of a rotating housing and earcup of the headset of FIG. 2.

FIG. 3 is an enlarged and partially-exploded depiction of the rotating housing 3 for the LED 2 of the second embodiment. The LED 2 is mounted in a hole in the periphery of the hollow, cylindrical housing 3 such that emitted light shines radially outward. LED wires 7 project from the end of the housing 3 for connection to the switch 1 and ANR circuitry 50 inside the earcup 20. A metallic "push nut" 8 slips over the part of the rotating housing 3 which projects inside the earcup 20 and retains the housing 3 in the earcup 20.

Thus it can be seen from the illustrations that this invention provides a practical means of providing supplemental cockpit illumination. The addition of weight and structure to the headset 100, 200 is minimized. This conserves headset volume and minimizes interference between the headset 100, 200 and nearby structure and equipment. Since power is provided by the intercom system, the vehicle the headset 100, 200 is used in, or from batteries incorporated in the headset 100, 200 for the purpose of powering ANR systems, no additional batteries are necessarily required.

It should be emphasized that the above-described embodiments of the present invention, are merely possible examples of implementations, merely set forth for a clear understanding of the principles of the invention. Many variations and modifications may be made to the above-described embodiment(s) of the invention without departing substantially from the spirit and principles of the invention. For example, it will be appreciated by those skilled in the art that the particular manner in which the LEDs are controlled (i.e. with a knob or switch) could be chosen from any means capable of doing so. Additionally, other means for providing power to the headsets 100, 200 aside from those discussed could be utilized. All such modifications and variations are intended to be included herein within the scope of the present invention and protected by the following claims.

What is claimed is:

1. An aviation-style headset, the headset comprising:

a first earcup and a second earcup each comprising active noise reduction (ANR) circuitry;

a headband interconnecting the first earcup and the second earcup;

a boom microphone coupled to one of the earcups;

a rotating housing coupled to at least one of the earcups;

at least a first LED mounted in the rotating housing, the rotating housing being rotatable to direct light from at least the first LED to a desired direction;

a switch mounted to one of the earcups for controlling the LED;

the ANR circuitry being electrically coupled to at least the first LED to provide power to the at least first LED;

a volume control knob; and wherein the switch is incorporated within the volume control knob such that rotating the knob controls the volume and pulling the knob controls the LEDs.

* * * * *